US005760517A

United States Patent [19]

Stolpmann

[11] Patent Number: 5,760,517

[45] Date of Patent: Jun. 2, 1998

[54] PLUG-IN COMMUTATOR AND PROCESS FOR ITS MANUFACTURE

[75] Inventor: Helmut Stolpmann, Friedingen, Germany

[73] Assignee: Kirkwood Industries, GmbH, Herrenberg, Germany

[21] Appl. No.: 817,396

[22] PCT Filed: Aug. 8, 1996

[86] PCT No.: PCT/EP96/03505

§ 371 Date: Jun. 6, 1997

§ 102(e) Date: Jun. 6, 1997

[87] PCT Pub. No.: WO97/07573

PCT Pub. Date: Feb. 27, 1997

[30] Foreign Application Priority Data

Aug. 16, 1995 [DE] Germany ..... 195 30 051.3

[51] Int. Cl.[6] ..... H01R 43/06

[52] U.S. Cl. ..... 310/233; 310/235; 310/236

[58] Field of Search ..... 310/233, 235, 310/236, 42, 43

[56] References Cited

U.S. PATENT DOCUMENTS 4,983,871 1/1991 Strobl ..... 310/234

FOREIGN PATENT DOCUMENTS

WO 95/14319 5/1995 Germany ..... H01R 43/06

WO 95/17031 6/1995 Germany ..... H01R 43/06

*Primary Examiner*—Steven L. Stephan

*Assistant Examiner*—B. Mullins

*Attorney, Agent, or Firm*—Wigman, Cohen, Leitner & Myers, P.C.

[57] ABSTRACT

In the case of a plug-in commutator with a hub body (1) consisting of an electrical isolation material and having evenly distributed and positioned grooves of like design over its circumference, in which each of the segments (5)—of like design—which form the commutator path, is inserted by forming a form-fit connection in radial direction, the segments (5) are safeguarded from a shift in relation to the hub body (1) by a clamping force that is based on an overdimension (x, z) of the segments (5) and/or of material parts of the hub body (1) that facilitate the positioning of the segments (5). Only in the area of the two end sections (18, 21) of the segments (5) and/or the grooves is the overdimension (x, z), which determines the clamping force exerted on the segments (5), provided.

21 Claims, 6 Drawing Sheets

PLUG-IN COMMUTATOR AND PROCESS FOR ITS MANUFACTURE

BACKGROUND OF THE INVENTION

The invention concerns a plug-in commutator, and a process for its manufacture.

In a known plug-in commutator of this type (WO 95/14319), the force needed to insert the segment into the groove is so great that disturbances during insertion cannot be ruled out. If one were to reduce this force by reducing either the overdimension of the segments and/or the underdimension of the groove, then a reliable positioning of the segments in the hub body can no longer be guaranteed.

OBJECTS AND SUMMARY OF THE INVENTION

The problem the invention seeks to solve, then, is to create a plug-in commutator in which the segments are positioned in a reliable fashion in the grooves in spite of the fact that the force necessary for the insertion of the segments into the grooves is reduced. The plug-in commutator solves this problem with the properties of the independent apparatus claim, whereby below an overdimension, an underdimension that brings about a clamping force is also understood. A process for the manufacture of the plug-in commutators according to the invention is also the subject of claim 15 the independent process claim. Advantageous designs of the plug-in commutator according to the invention and the manufacturing process according to the invention are the subject matter of the subclaims.

For an exact and reliable positioning of the segments in the grooves, it is completely satisfactory—as has been demonstrated—when the maximum value of the clamping force exerted on the segments is determined by the clamping in the area of the two end sections of the segments. Moreover, the result of this is that the high clamping forces, and in turn, the friction that must be overcome when inserting the segments in the grooves, occurs only in the two end sections, which considerably reduces the force necessary to insert all the segments in the grooves at the same time, whereby the maximum value of this force only occurs when the lagging end of the segments enters into the grooves.

In a preferred working model, the grooves have the necessary overdimension in that end section that takes up the leading end of the segments during insertion; and the segments have the necessary overdimension in the segments in their lagging end sections. The segments, then, can be inserted into the grooves with very little force until the leading end reaches the end section of the grooves displaying the overdimension and the leading end section of the segments enter into the grooves.

The axial extension of the zones that have the overdimension can be different. In this connection, a larger axial extension comes into consideration in both the area of the end section of the segments that lead during insertion and in the area of its lagging end. In the preferred model, the axial extension of the zones displaying the overdimension is around 15% in the area of the leading end section; in the area of the lagging end section it is around 5% of the length of the parts of the segments forming the commutator path.

In the middle section of the segments and grooves that lies between the two end sections a gap can exist between the surface areas of the segments, which overlap in radial direction, and the hub body; relatively speaking, this gap is usually, however, quite small.

In a preferred form of the model, the segments display a middle piece—which extends in wedge-like form from the headpiece to the footpiece—between their headpiece, which forms the commutator path, and a footpiece; this middle piece is clamped in between the sides of the corresponding groove. Thanks to the wedge form of this middle part, the clamping force acting on the sides of the middle part has a radial component, which presses the surfaces of the segments, which are intended for radial positioning, against the surfaces of the hub body corresponding to them.

The radial positioning of the segments can take place by pressing the shoulders against the surface area of the crosspieces turned against them when—as is the case in a preferred working model—the width of the headpiece of the segments—as measured in the circumferential direction of the commutator—is larger than the corresponding width of the middle part, on which a shoulder (which overlaps the directly adjoining crosspieces of the hub body bordering the grooves on the sides) is displayed on each side on the ends that are connected to the headpiece and on the segments on the transition from the middle part to the headpiece.

Preferably, the two shoulders of these segments overlap less than half of the end surface of the directly adjoining crosspieces turned toward them. Between the headpieces of the two adjoining segments the necessary interval, in circumferential direction, therefore exists. In this connection, the gap between the headpieces of adjoining segments is, preferably, free of the material parts of the hub body.

In a preferred working model, the footpiece of each segment, which is connected to the wider end of the middle part in a first section, displays a reduced width—when forming a shoulder in the area of both sides—and a larger width with respect to the first section in a second section that is connected to the first section—when forming a shoulder in the area of both sides. In this case the footpiece has a cross-sectional profile similar to a T.

Preferably, the middle part of the segments rests—all over the surface—against the sides of the groove that takes them up. Instead of a positioning of the shoulders of the segments, which exist at the transition from the middle part to the headpiece, on the end surfaces of the crosspieces, one can also provide for a positioning of the end surface of the footpiece, which is turned away from the headpiece, under pressure, at the base of the groove that takes up the segment for the purpose of the radial positioning. The aforementioned positioning is especially advantageous in the area of the lagging end of the segments and the positioning of the shoulders on the end surfaces of the crosspieces in the area of the leading end.

In the application of the theory according to the invention, the size of the commutator and the relation between the spacing and the size of the commutator are not important. In the case of plug-in commutators with a small diameter and large spacing intervals, it can, however, be the case that in maintaining the necessary distance between the individual segments, the sides of the segments that serve as bearing surfaces are designed too short. To meet the demands made on performance it is therefore of advantage that the segments meant for anchoring have at least two pair of bearing surfaces. Preferably, the angles between the pairs are different for each pair. In this way, one can be sure that all bearing surfaces rest against the crosspieces in spite of process tolerances.

During the production of customary commutators the segments are first placed in a basket, which specifies the positioning when the segments are inserted into the grooves. This basket is then put in an injection molding die or a compression molding die and is pressed or injected. The plastic basket can only be used once. On the other hand, the basket is not used in a process according to the invention in which the clamping force is determined alone by the overdimension in the area of the end sections of the segments and/or the area of the material parts of the hub body that facilitate the positioning of the segments. The exact positioning takes place through the areas that are not provided with an overdimension. The clamping power, which builds up at the end of the insertion procedure, no longer influences the positioning. With the elimination of the basket, both material savings and a shortening of the manufacturing process are linked to the steps of equipping and removing the basket. By eliminating the basket it is also possible to bend the hooks, which serve to connect the segments electrically, in a tool during the production of the segments. The bending process is left out of the work cycle.

It is more advantageous to choose the pressure and, if applicable, the temperature during the insertion of the segments so that instead of having, to a large extent, an insoluble molding bond between the hub body and the segments, the hub body and the segments can be separated from one another again. A plug-in commutator manufactured according to such a process is thus recyclable.

BRIEF DESCRIPTION OF THE DRAWINGS

In the following the invention is illustrated by using two working models that are represented in detail in the drawings.

DETAILED DESCRIPTION OF THE PREFERRED EMBODIMENTS

Figure 1:
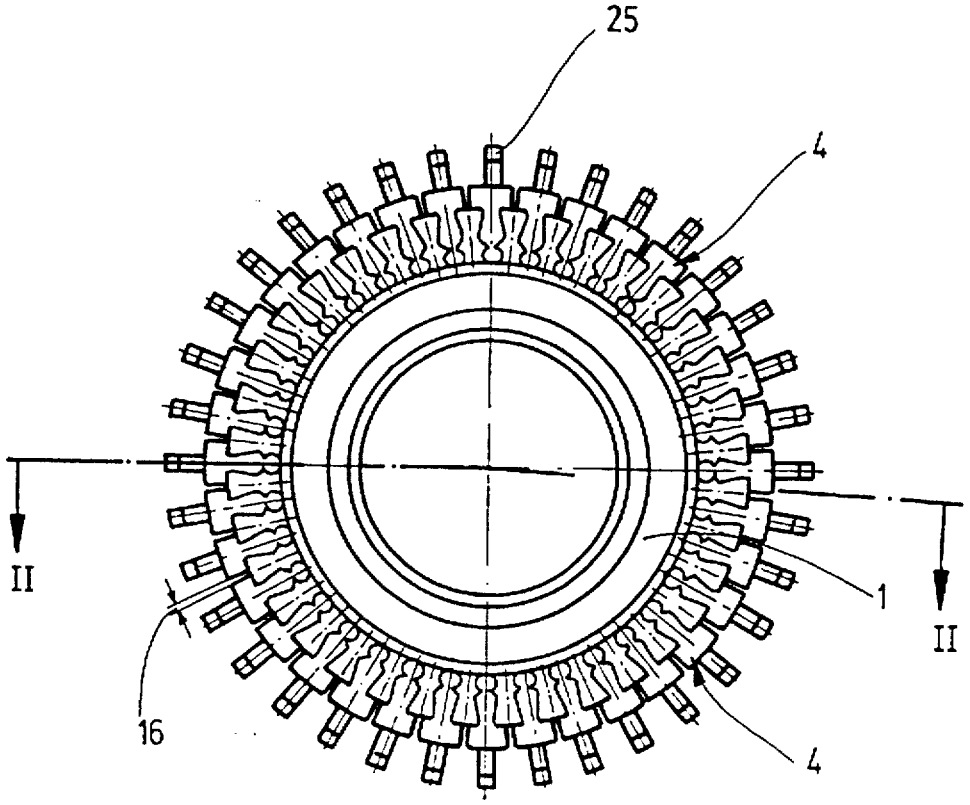
FIG. 1 shows a front view of the first working model.
Figure 2:
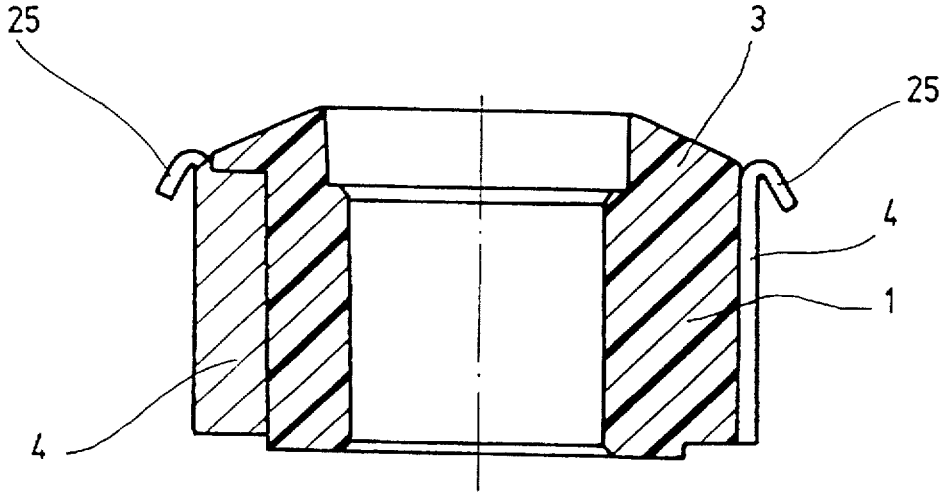
FIG. 2 shows a cut according to line II—II of FIG. 1.

A plug-in commutator displays a hub body (1), which consists of an electrical isolation material and which is provided with open grooves (2) over its circumference that are evenly distributed and positioned, of like design, and run in axial direction as well as radially outward. As FIG. 2 shows, the grooves (2) begin at one end of the hub body (1), but end at a distance from the other end, whereby the end of all the grooves (2) lies on a radial plane. The hub body (1) in the working example consists of a molding material on a phenol basis. Other isolating materials, such as thermoplast or ceramic, can, however, be considered. In addition, the material can have fiber reinforcement. After production, the hub body (1) can be malleablized at a temperature that is above the working temperature.

Figure 4:
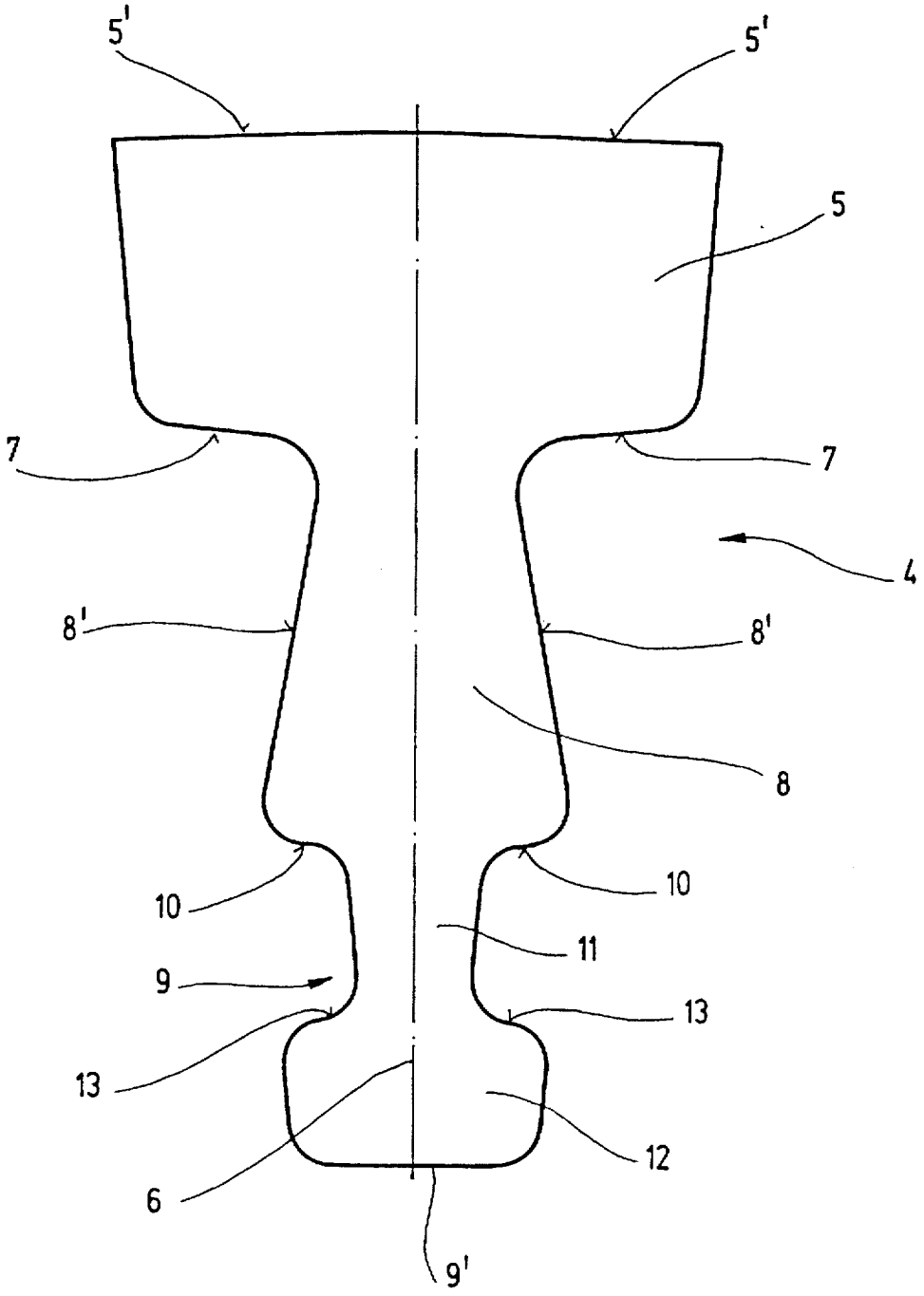
FIG. 4 shows a front view of one of the segments.

In each of the grooves (2) a segment (4) is set up. The segments (4), which are of like design, consist of a material that conducts electricity well and is customary for commutator segments. As, for example, FIG. 4 shows, the segments (4) display a headpiece (5), whose cylindrically bent end surface (5') forms a part of the commutator path. The segments (4) are designed so they are symmetrical to their longitudinal middle plane (6). On the headpiece (5), a middle part (8) is connected by forming a shoulder (7) in each case; the width of the middle part—measured in circumferential direction—on the end passing through a rounded out section in the shoulders (7) is smaller than the width of the headpiece (5) by the width of the shoulders (7). The shoulders form an open obtuse angle that opens toward the end surface (5'). The middle part (8) extends like a wedge from the headpiece (5) to a footpiece designated, as a whole, as 9. Both of its flat sides (8') form an angle of 20° in the working example. The footpiece (9) has a first section (11) that is connected to the middle part (8) via a shoulder (10); the width of the first section in the area of the shoulders (10) is smaller than the width of the middle part (8) by the width of the shoulder. The width of the first section (11) grows steadily smaller toward the second section (12), which is connected to it. Connected in each case via a shoulder (13) is the second section (12), whose width grows steadily smaller toward its end surface (9'). The footpiece (9) therefore has a cross-sectional profile shaped like a T.

Figure 5:
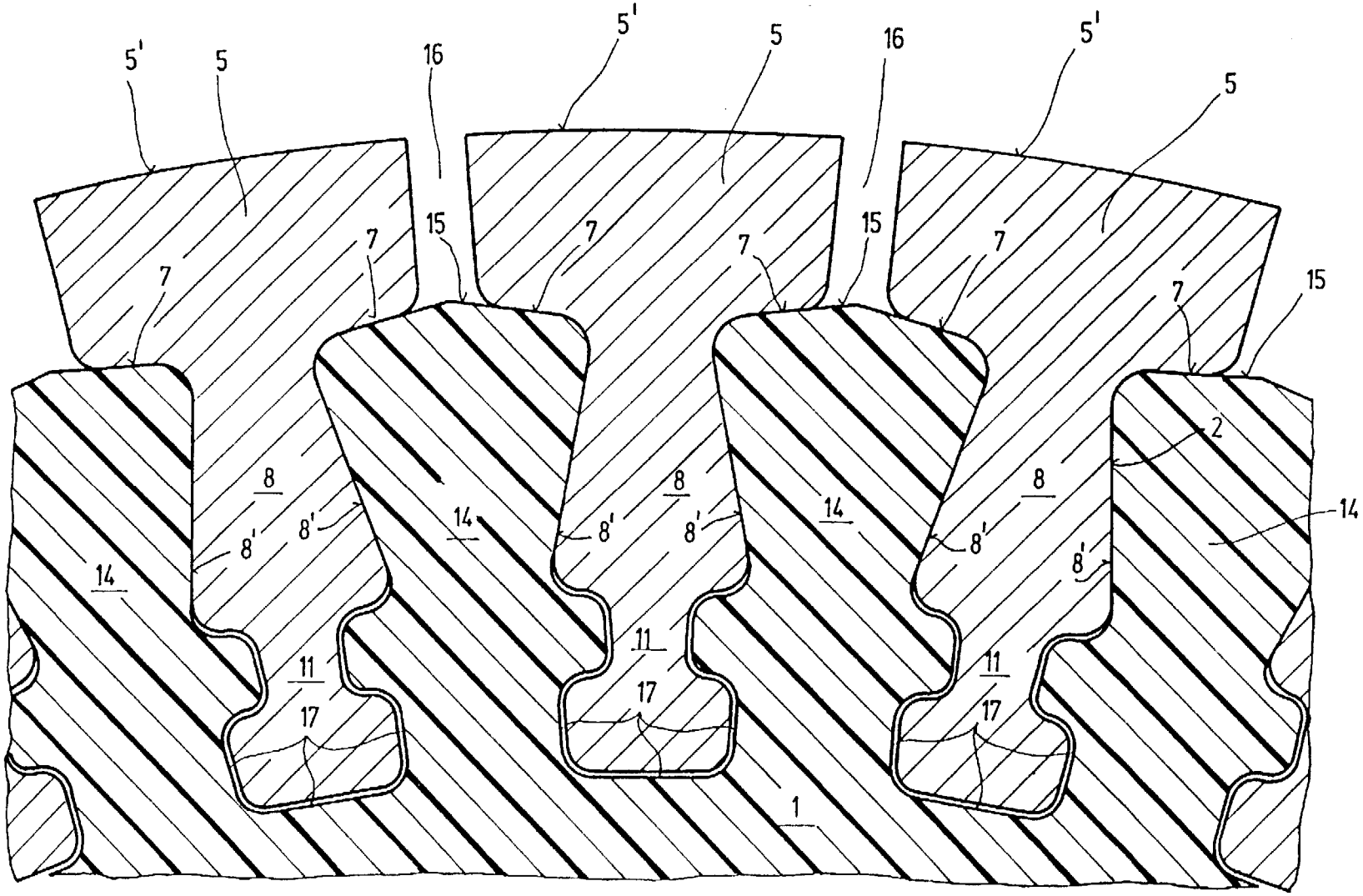
FIG. 5 shows an enlarged and incompletely represented cross section of the first working model in the area of the leading section of the segments.

As, in particular, FIG. 5 shows, when the segments (4) are inserted into the grooves (2), both shoulders (7) overlap the crosspieces (14) of the hub body (1), which border the grooves on the sides, by less than half of the end surface (15), which is turned toward the headpiece (5). For this reason a slot (16), into which no material parts of the hub body (1) project in the working example, exists between the two adjoining segments (4). The side surfaces of the headpiece (5), which border on the slot (16), run parallel to each other.

As FIG. 5 further shows, the two sides (8') of the middle part (8) of each segment (4) rest—all over the surface—against the crosspieces (14). The part of each groove (2) that takes up the footpiece (9) has a cross-sectional form that is geometrically similar to the footpiece (9), but the measurements of the groove (2) in this part are a little larger than the measurements of the footpiece (9). As a result, a small gap (17) exists between the footpiece (9) and the bordering side surfaces of the part of the grooves (2) that take up the footpiece (9).

Figure 3:
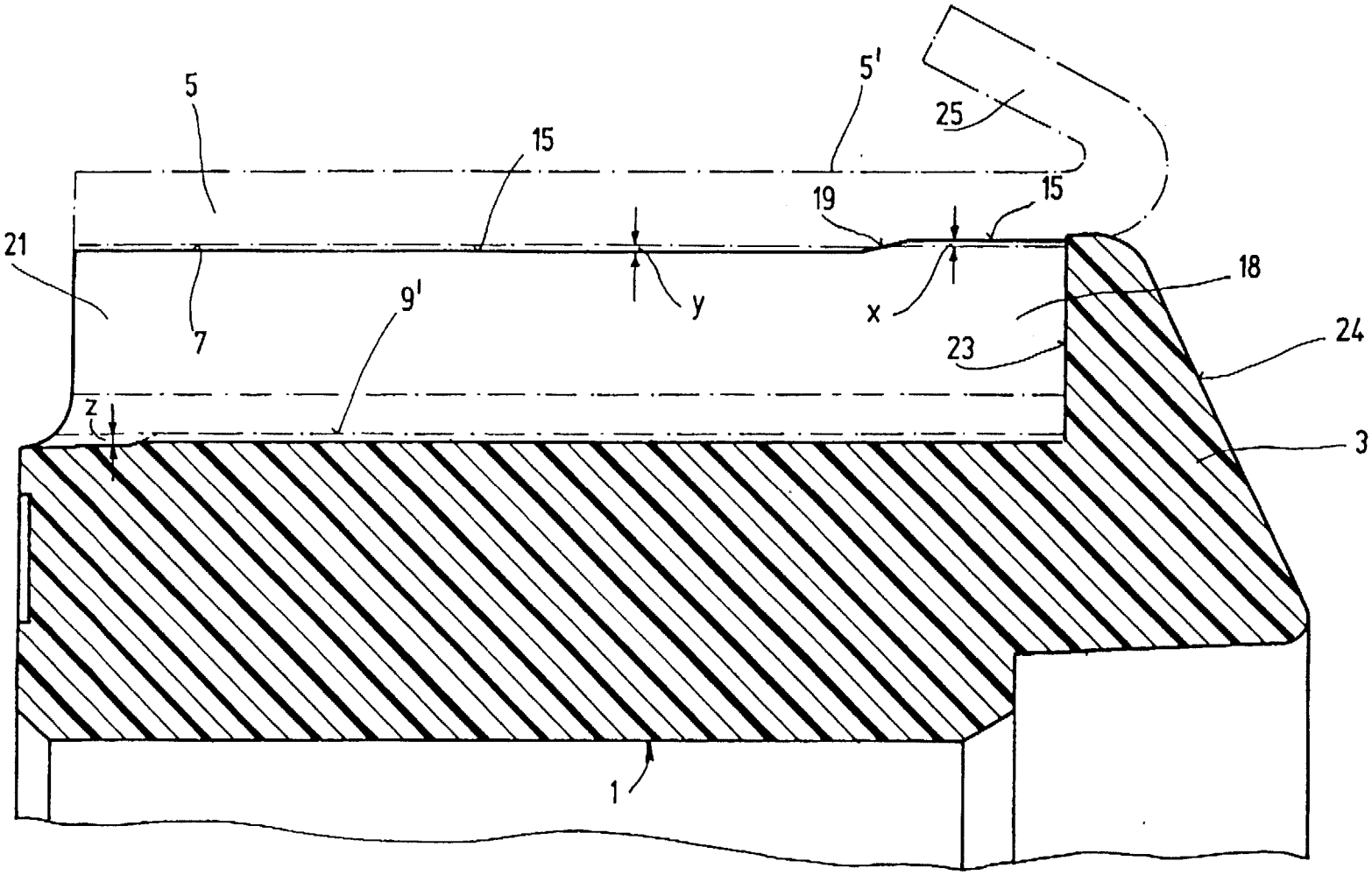
FIG. 3 shows an enlarged cut-out from FIG. 2.
Figure 6:
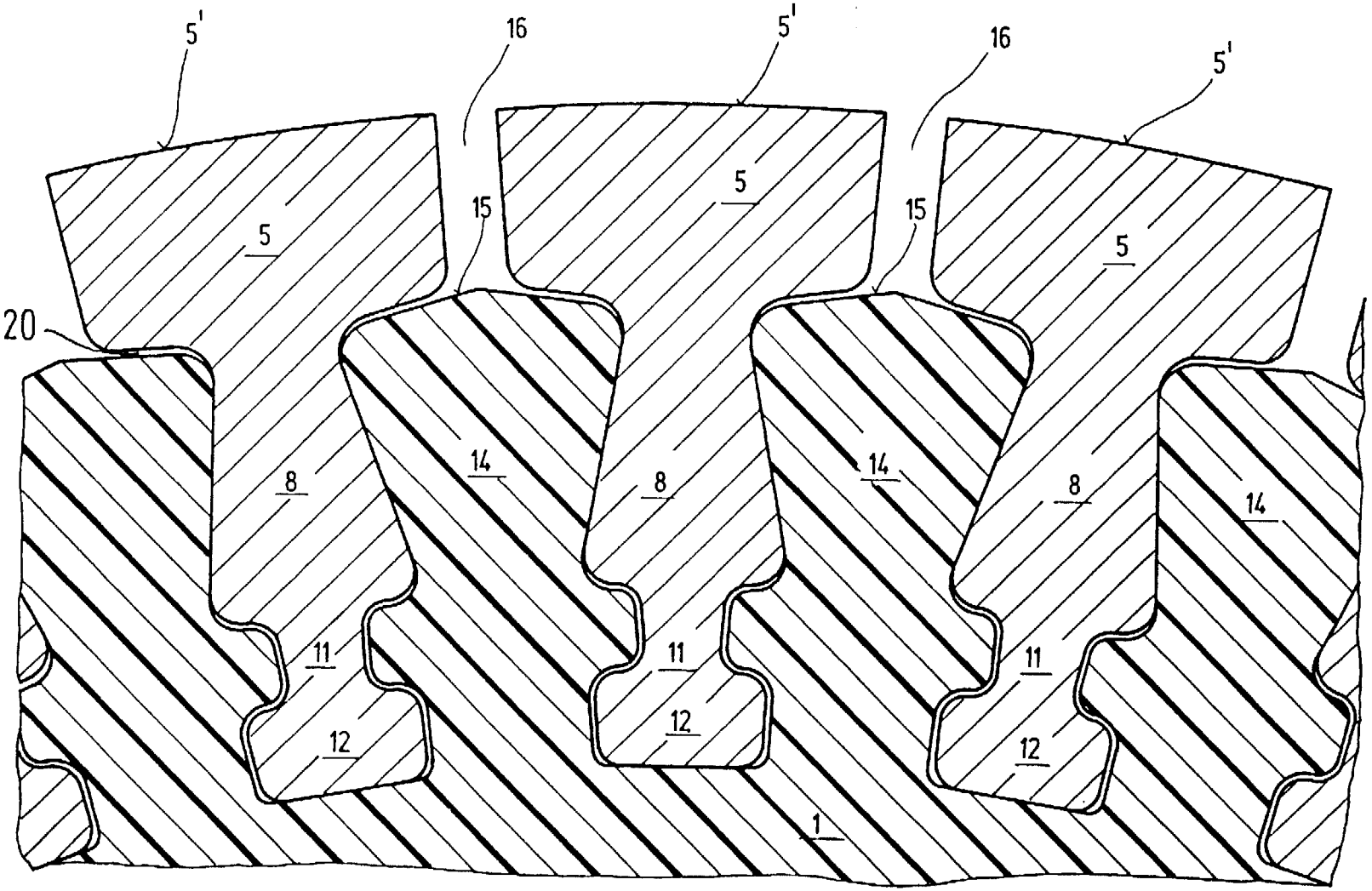
FIG. 6 shows a cross section of the first working example in the area of the lagging end section of the segments corresponding to FIG. 5.
Figure 7:
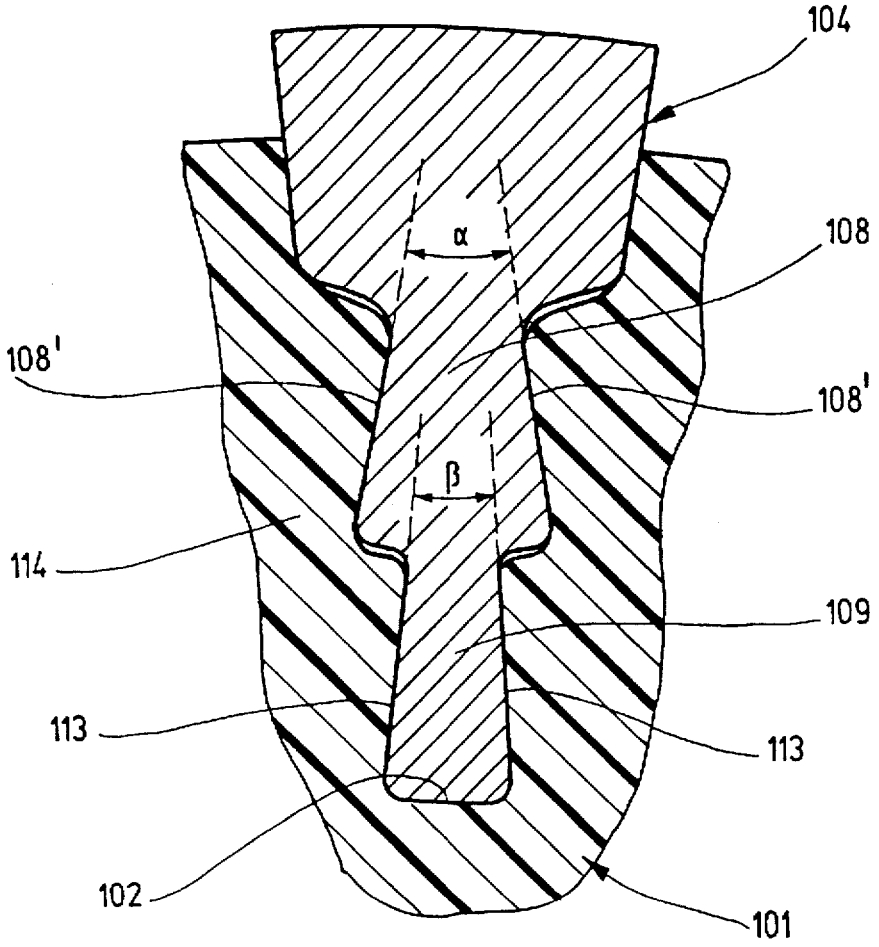
FIG. 7 shows an enlarged and incompletely represented cross section of the second working model in the area of the lagging end section of the segment.

As FIG. 3 shows, the crosspieces (14) in zone (18), in which the leading end section of the segments (4) comes to a halt in a completely inserted state—when the segments (4) are inserted in the grooves (2)—have an overdimension on the end surfaces (15) of the crosspieces (14) in radial direction; the overdimension (as FIG. 5, which represents a cut through zone 18, shows) leads to the fact that the shoulders (7) rest—all over the surface—against the end surfaces (15), with pressure, as a result of which the clamping force, which is exerted on the sides (8') of the middle part (8), is increased. The clamping power just mentioned has a component, which is set against the footpiece (9). The gap (17) extends in zone (18) between the end surface (9') of the footpiece (9) and the base of the groove (2). The axial length of the zone (18) with the overdimension (x) amounts to about 15% of the axial length of the grooves (2) in the working example. Via a ramp (19), the transition takes place from the zone (18) to the remaining part of the crosspieces (14), in which the end surfaces (15) of the crosspieces (14) have a negative overdimension, i.e., an underdimension (y). Wherever an underdimension (y) exists, as FIG. 6 shows, a gap (20) exists between the end surfaces (15) of the crosspieces (14) and the shoulders (7).

In the area of the end section that lags during the insertion of the segments (4) into the grooves (2), the segments (4)

have a zone (21) with an overdimension (z) in radial direction of the end surface (9') of their footpiece (9). This overdimension (z) has as a consequence—as FIG. 6, which represents the cut through the zone (21), shows—that the end surface (9') rests against the base of the corresponding groove (2), with pressure, and the clamping force rises, which the crosspieces (14) exert on the sides (8') of the middle part (8). As a consequence, a narrow slot (20) exists in the area of zone (21) between the shoulders (7) and the end surfaces (15) of the crosspieces (14).

The overdimensions (x and z) are chosen so that the clamping forces exerted on the segments (4) do not fall below the value necessary to guarantee the positioning and determination of the segments (4) in the hub body (1).

But the force necessary for the simultaneous insertion of all the segments (4) into the grooves (2) from the beginning of the insertion procedure to the time zone (18) is reached by the leading end of the segments (4) is, however, very small because in this case only the clamping force—at first very small—which the crosspieces (14) exert on the middle part (8), must be overcome. Only when the leading end section of the segments (4) is inserted into the zone (18) does the necessary insertion force rise sharply and reach its maximum value when the end surface (9') of the footpiece (9) enters the zone (21) in position at the base of the corresponding groove (2), whereby this entrance is made easier through a ramp, which acts as a transition to the zone (21). When the segments (4) are completely inserted into the grooves (2), the leading end rests, as FIG. 3 shows, against a surface (23), which lies at a distance from the adjoining conical forepart (24) of the hub body (1) in the working example, and borders on the groove (2) in axial direction. All surfaces (23) lie on a common radial plane.

Hooks (25) in the working example, which are formed on the segments (4) and which facilitate the connection of the segments (4) to the conductors of a rotor coil, lie on the outer surface area of the end section of the hub body (1), which borders on the surfaces (23) and the conical forepart (24).

A further working example concerns a plug-in commutator, whose segments (104) display two pairs of bearing surfaces, but which otherwise concurs in all the details of the first working example, which have not been described here. The middle part (108) of each segment (104) has a pair of sides (108'), which are designed as bearing surfaces on the crosspieces (114) of the hub body (101), as in the first working example. The pair of sides (108'), opened radial inwards, forms an angle a. The footpiece (109) of each segment (104)—which lies radially inwards, has a further pair of sides (113), which are also designed as bearing surfaces on the crosspieces (114). This additional pair of sides (113) forms an angle $\alpha$ and also opens radially inwards. The angle $\beta$is smaller than angle $\alpha$. In the limiting case $\beta$ can equal 0°, that is, the sides (113) run parallel to each other.

When inserting the segments (104) in the grooves (102) of the hub body (101), the segments (104) are pressed radially outwards through the overdimension in the end section. In so doing, the sides (113) provided on the footpiece (109) come into position with the crosspieces (114). Through the small angle $\alpha$, the crosspieces (114) counteract the insertion of the segments (104) with just a small force. With further insertions, the sides (113) are pressed into the hub body (101) until the sides (108') provided on the middle part (108) come into position with the crosspieces (114). With the correct choice of the angles $\alpha$ and $\beta$ and the other dimensioning of the segments (104) and the crosspieces (114), all the pairs of sides (108' and 113) therefore come into position on the crosspieces (114). In the case of compression-proof hub bodies (101) it is advantageous when the crosspieces (114) in the area of the footpieces (109) have a somewhat larger opening angle inwards in comparison with $\beta$. In this way only a part of the sides (113) comes into position—which reduces the counteracting force.

In the case of a process according to the invention, the hooks (25) are bent after the production of the segments (4, 104), which are still in the tool. The segments (4, 104) are then pushed—i.e., inserted—directly into the hub bodies (1, 101). The parameters for insertion, especially the pressure and, if applicable, the temperature, are chosen in such a way that no insoluble molding bond arises. Alternatively, the boring of the hub body (1, 101) can be worked on after the insertion of the segments (4, 104). Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. A plug-in commutator apparatus having a commutator surface, said apparatus comprising:

a hub body made of an electrical isolating material, said hub body having radially and axially extending crosspieces and grooves provided between said crosspieces, wherein said grooves are evenly distributed and positioned along a periphery of said hub body with outer surfaces of said crosspieces and openings to said grooves forming said periphery of said hub body;

a plurality of segments insertable in said grooves, each segment having a headpiece that forms at least a part of said commutator surface; and means for securing said segments in said grooves, said securing means selected from the group consisting of overdimensions located along surfaces at axial end sections of said crosspieces defining said grooves, overdimensions located along axial end sections of said segments, and overdimensions located along surfaces at said axial end sections of said crosspieces defining said grooves and said axial end sections of said segments, wherein said overdimensions cause said walls of said crosspieces defining said grooves to hold said segments when said segments are fully inserted in said grooves.

2. Apparatus according to claim 1, wherein each groove has a front section and a back section, wherein each segment has a leading end section and a trailing end section, wherein said leading end sections of said segments are located in said back sections of said grooves when said segments are fully inserted in said grooves, wherein said trailing end sections of said segments are located in said front sections of said grooves when said segments are fully inserted in said grooves, and wherein said securing means comprises overdimensions located along surfaces of said crosspieces forming said back sections of said grooves and overdimensions located along trailing end sections of said segments.

3. Apparatus according to claim 2, wherein each of said crosspiece overdimensions has a first axial length, wherein each of said segment overdimensions has a second axial length, and wherein said first axial length is greater than said second axial length.

4. Apparatus according to claim 1, wherein each of said segments further comprises a headpiece, a footpiece, and a middle part having a first end connected to said headpiece and a second end connected to said footpiece, said middle part having bearing surfaces frictionally engaged by surfaces of said crosspieces defining said groove.

5. Apparatus according to claim 4, wherein each of said segments is generally symmetrical to a central axis thereof.

6. Apparatus according to claim 5, wherein said headpiece has a width that is larger than a corresponding width of said middle part, and wherein sloped shoulders connect said headpiece to said first end of said middle part.

7. Apparatus according to claim 6, wherein said shoulders of each of said segments overlap at least a portion of said outer surfaces of said crosspieces.

8. Apparatus according to claim 7, wherein said shoulders overlap only a portion of said outer surfaces of said crosspieces, and wherein gaps are formed between side surfaces of adjacent headpieces.

9. Apparatus according to claim 8, wherein no material parts of said hub body project into said gaps.

10. Apparatus according to claim 5, wherein said footpiece has a first section connected to said second end of said middle part and a second section connected to said first section, wherein said first section has a width that is smaller than a width of said middle part, and wherein said second section has a bottom base and a width that is larger than said width of said first section.

11. Apparatus according to claim 10, wherein said width of said first section grows steadily smaller from said second end of said middle part to said second section of said footpiece, and wherein said width of said width of said second section grows steadily smaller from said first section to said base.

12. Apparatus according to claim 5, wherein said middle part is engaged by said surfaces of said crosspieces forming said grooves at all stages of insertion.

13. Apparatus according to claim 4, wherein said securing means comprises at least said overdimensions located along said surfaces at said axial end sections of said crosspieces defining said grooves, wherein each segment further comprises sloped shoulders connecting said headpiece to said first end of said middle part, and wherein said shoulders press against said outer surfaces of said crosspieces at regions where said overdimensions are located.

14. Apparatus according to claim 4, wherein said securing means comprises at least said overdimensions located along axial end sections of said segments, wherein each of sed segments has an inner base surface, and wherein said inner base surfaces of said segments press against a bottom, inner surface of said groove at regions where said overdimensions are located.

15. Apparatus according to claim 4, wherein said securing means comprises at least said overdimensions located along said surfaces at said axial end sections of said crosspieces defining said grooves, and wherein said surfaces of said crosspieces defining said groove further comprise ramped sections extending up to said overdimensions.

16. Apparatus according to claim 1, further comprising hooks formed on said segments.

17. Apparatus according to claim 1, wherein each of said segments further comprises a headpiece, a footpiece, and a middle part having a first end connected to said headpiece and a second end connected to said footpiece, and wherein said middle part and said footpiece have bearing surfaces that frictionally engage surfaces of said crosspieces defining said groove.

18. Apparatus according to claim 17, wherein said bearing surfaces of said footpiece are continuous and slope inward and downward from said middle part at a first angle, said bearing surfaces of said middle part are continuous and slope inward and downward from said headpiece at a second angle, and wherein said first angle is different than said second angle.

19. A process for manufacturing a plug-in commutator comprising:

providing a hub body made of an electrical isolating material, said hub body having radially and axially extending crosspieces and grooves provided between said crosspieces, wherein said grooves are evenly distributed and positioned along a periphery of said hub body with outer surfaces of said crosspieces and openings to said grooves forming said periphery of said hub body; a plurality of segments insertable in said grooves, each segment having a headpiece that forms at least a part of said commutator surface; and means for securing said segments in said grooves, said securing means selected from the group consisting of overdimensions located along surfaces at axial end sections of said crosspieces defining said grooves, overdimensions located along axial end sections of said segments, and overdimensions located along surfaces at said axial end sections of said crosspieces defining said grooves and said axial end sections of said segments, wherein said overdimensions cause said walls of said crosspieces defining said grooves to hold said segments when said segments are fully inserted in said grooves;

inserting simultaneously all of said segments axially into said grooves of said hub body, wherein said inserting step further comprises overcoming an insertion resisting force resulting from said overdimensions and fully inserting said segments in said grooves to secure said segments against displacement relative to said hub body.

20. Process according to claim 19, further comprising providing hooks on said segments and electrically connecting said hooks following said inserting step, said electrically connecting step further comprising bending ends of said hooks.

21. Process according to claim 19, wherein said segments are inserted in said grooves of said hub body under sufficient pressure and temperature such that said hub body and said segments can be separated from each other.

* * * * *

UNITED STATES PATENT AND TRADEMARK OFFICE

CERTIFICATE OF CORRECTION

PATENT NO. : 5,760,517

DATED : June 2, 1998

INVENTOR(S) : Helmut STOLPMANN

It is certified that error appears in the above-indentified patent and that said Letters Patent is hereby corrected as shown below:

In column 1, line 28, delete "claim 15."

Signed and Sealed this

Sixteenth Day of March, 1999

*Attest:*

Q. TODD DICKINSON

*Attesting Officer*

*Acting Commissioner of Patents and Trademarks*